US006890211B2

(12) United States Patent
Inagaki et al.

(10) Patent No.: US 6,890,211 B2
(45) Date of Patent: May 10, 2005

(54) CONNECTOR HOLDING STRUCTURE

(75) Inventors: Keiji Inagaki, Okazaki (JP); Tsutomu Santanda, Toyota (JP)

(73) Assignees: Mitsubishi Jidosha Kogyo Kabushiki Kaisha (JP); Yazaki Corporation (JP)

( * ) Notice: Subject to any disclaimer, the term of this patent is extended or adjusted under 35 U.S.C. 154(b) by 0 days.

(21) Appl. No.: 10/305,782

(22) Filed: Nov. 27, 2002

(65) Prior Publication Data

US 2003/0157830 A1 Aug. 21, 2003

(30) Foreign Application Priority Data

Nov. 27, 2001 (JP) ..... 2001-361441
Nov. 29, 2001 (JP) ..... 2001-363890

(51) Int. Cl.[7] ..... H01R 13/73

(52) U.S. Cl. ..... 439/544; 439/34; 439/374; 362/492

(58) Field of Search ..... 439/544–545, 439/570–573, 374, 34; 362/492

(56) References Cited

U.S. PATENT DOCUMENTS 5,430,624 A * 7/1995 Yoshida et al. ..... 362/492
6,113,253 A * 9/2000 Yoshii et al. ..... 362/492
6,270,240 B1 * 8/2001 Inoue ..... 362/492
6,390,658 B2 * 5/2002 Maeda ..... 362/546
6,494,481 B2 * 12/2002 Yasuda ..... 280/732

* cited by examiner

*Primary Examiner*—Tho D. Ta
*Assistant Examiner*—X. Chung-Trans
(74) *Attorney, Agent, or Firm*—Rossi, Kimms & McDowell

(57) ABSTRACT

A connector holding structure which facilitate an operation of inserting a connector from the bottom surface of a headlining to the top surface thereof and prevents an occurrence of damage of the connector and abnormal noises due to vibrations of the connector. The connector holding structure has an accommodating mechanism fixed onto the top surface of the headlining. The accommodating mechanism comprises an accommodating body extending in a direction departing away from an interior part attaching hole formed in the headlining, and also comprises a guide portion for guiding the connector to a predetermined position in the accommodating body, and a holding member for holding the connector at the predetermined position.

13 Claims, 14 Drawing Sheets

CONNECTOR HOLDING STRUCTURE

BACKGROUND OF THE INVENTION

1. Field of the Invention

The present invention relates to a connector holding structure, particularly to a connector holding structure suitable for holding a connector attached to ends of electric wires for supplying electric power to interior parts such as a sun visor, after a vehicle headlining is mounted on a vehicle.

2. Description of the Related Art

Hitherto, there has been known a sun visor having an face mirror (or vanity mirror) with a lighting lamp provided on a side that is opposite to a vehicle occupant during use of the sun visor that serves as an interior part.

A conventional structure for attaching such a sun visor is described below with reference to FIGS. 17 to 19. Reference numeral 4 denotes a sun visor, reference numeral 3 denotes a headlining, and reference numeral 8 denotes a body bracket.

The sun visor 4 comprises a sun visor body 4*a*, which is equipped with a vanity mirror (not shown) having a lighting lamp, and also comprises an arm 5, a base member 6, and harnesses 2*b*.

The arm 5 is formed into a shape bent nearly at a right angle. The arm 5 has a cavity formed inside thereof. One end of the arm 5 is connected to the sun visor body 4*a* in such a way as to enable the sun visor body 4*a* to turn around the arm 5 in vehicle front and rear directions. The other end of the arm 5 is rotatably attached to the bottom surface of the base member 6.

In the base member 6, holes 6*a* and 6*b* each for attaching the sun visor 4 to the headlining 3 are formed. A hole portion 6*c* communicated to the cavity of the arm 5 is formed in a center of the base member 6.

The harnesses 2*b* are electric wires for supplying electric power to the lighting lamp of the vanity mirror that has the lighting lamp and that is equipped in the sun visor body 4*a*. One end portion of each of the harnesses 2*b* is connected to the lighting lamp. The other end portion of each of the harnesses 2*b* is made to upwardly extend from the base member 6 through the inside of the arm 5 and the central hole portion 6*c* of the base member 6 and a suconnector 1*b* is attached to a top end thereof.

The headlining 3 is attached to the ceiling portion of a vehicle interior. A hole (or attaching hole) for attaching the sun visor 4 thereto is formed therein.

Each of the harnesses 2*a* has an end connected to a battery (not shown) provided in an engine room and also has the other end, to which a subconnector 1*a* is attached. Each of the harnesses 2*a* is drawn from the engine room and attached onto a top surface of the headlining 3 through the inside of a pillar trim (not shown).

The body bracket 8 has a welding portion 8*c*, which is welded to a roof rail (not shown) provided on the ceiling portion of the vehicle interior, and also have nuts 8*a* and 8*b*, which are welded to places corresponding to the bolt holes 6*a* and 6*b* formed in the base member 6 of the sun visor 4, and a hole portion 8*d* formed in the center of the body bracket 8.

The conventional structure for mounting the sun visor is configured, as described above. In attaching the sun visor 4 to the headlining 3, the harnesses 2*a* are projected downwardly from the attaching hole of the headlining 3 to connect the subconnectors 1*a* and 1*b*. Then, a connector 1, in which the subconnectors are connected to each other, is pushed upwardly from the attaching hole 3*a* of the headlining 3 to thereabove.

Thereafter, bolts 7*a* and 7*b* are screwed into nuts 8*a* and 8*b* of the body bracket 8 through the bolt holes 6*a* and 6*b* of the base member 6 of the sun visor 4.

According to the conventional structure for attaching the sun visor, the sun visor 4 is attached to the headlining 3 by the aforementioned attaching procedure.

In the aforementioned conventional structure for attaching the sun visor, the attaching hole 3*a* formed in the headlining 3 is small. Further, owing to the shape of the body bracket 8, it is difficult to perform an operation of pushing the connector 1 to above the headlining 3. Moreover, in attaching the sun visor 4 to the headlining 3, a worker need to turn upwards. Thus, such an attaching operation is troublesome.

Thus, as shown in FIG. 18, when the sun visor 4 is attached to the headlining 3 with the bolts 7*a* and 7*b*, there is a possibility that harnesses 2*a* gets caught between the top surface of the headlining 3 and the bottom surface of the body bracket 8, and that the harnesses 2*a* are damaged.

Furthermore, as shown in FIG. 19, there is a possibility that the harnesses 2*a* abut against the body bracket 8 or the nuts 8*a* and 8*b*, and that the harnesses 2*a* are damaged.

Occurrences of such damage are possible not only in the harnesses 2*a* but also in the harnesses 2*b*.

Furthermore, the connector 1 is not fixed after the connector 1 is pushed upwardly from the attaching hole 3*a* of the headlining 3 to above the headlining 3. Thus, there is a possibility that the connector 1 vibrates and hits against the head lining 3, and that abnormal noises (or clicks) are caused during traveling of the vehicle.

SUMMARY OF THE INVENTION

An object of the invention is to provide a connector holding structure, which is adapted so that a connector is inserted from the bottom surface of a headlining and then attached onto the top surface thereof after the headlining is attached to a vehicle body, and which is enabled to facilitate an operation of inserting the connector from the bottom surface of a headlining to the top surface thereof and also enabled to prevent an occurrence of damage of the connector and generation of abnormal noises due to vibrations of the connector.

To achieve the foregoing object, according to the invention, there is provided a connector holding structure comprising: a connector for connecting a vehicle-body-side wire provided on a top surface side of a vehicle headlining to an interior-part-side wire provided on an interior part attached to an attaching hole formed in the headlining; and an accommodating mechanism for guiding the connector including subconnectors that are connected to each other at a bottom surface side of the headlining and being inserted from the bottom surface side of the headlining into the attaching hole to the top surface side of the headlining and for holding the connector, wherein the accommodating mechanism comprises: an accommodating body fixed onto a top surface of the headlining and extending in a direction departing away from the attaching hole; a guide portion for guiding the connector to a predetermined position in the accommodating body; and a holding member for holding the connector at the predetermined position.

Thus, the connector can easily be guided to the predetermined position in the accommodating body along the guide portion. Moreover, the guided connector can reliably be held at the predetermined position by the holding means. Furthermore, because the accommodating body is formed in such a way as to extend in a direction away from the attaching hole, the connector can be accommodated by being moved in a direction away from the attaching hole. Consequently, the connector and the harnesses can be prevented from being damaged when the interior part is attached in the attaching hole.

According to another aspect of the invention, the accommodating body is a cover body fixed onto the top surface of the headlining to thereby form a space, in which the connector is accommodated, between the cover body and the headlining. Moreover, the guide portion is an upper wall portion of the cover body formed into a shape protruding upwardly from the cover body by making a smooth curve from a front portion of the cover body to a rear portion thereof.

Thus, when the connector is inserted into the attaching hole by being pushed thereinto from the bottom-surface side of the headlining, the connector can smoothly be moved to the predetermined position.

Further, according to another aspect of the invention, the holding member comprises a position-regulating member for position-regulating the connector to a predetermined position, and a fixing portion for fixing the position-regulated connector.

Thus, the connector guided by the guide portion can reliably be fixed at the predetermined position.

Moreover, according to another aspect of the invention, the position-regulating member is a longitudinal wall formed at a rear end portion of the cover body and adapted to abut against the connector.

Thus, the guided connector can reliably be position-regulated by a simple structure.

Furthermore, according to another aspect of the invention, the fixing portion is a claw portion formed on a peripheral wall of the rear portion of the cover body in such a manner as to extend to the inside of the cover body.

Thus, the position-regulated connector can reliably be fixed by using a simple structure.

Further, according to another aspect of the invention, a fragile groove or a fragile slit portion is formed in an upper wall portion of the cover body from the front portion thereof to the rear portion thereof.

Thus, when an impact load at a vehicle collision is input to the structure, an upper portion of the cover body tears, so that the cover body is crushed. Consequently, an excessive impact force applied by the cover body to another part can be alleviated.

Furthermore, according to another aspect of the invention, the accommodating mechanism further comprises a flexible slide member adapted to engage the accommodating body in such a way as to be able to perform sliding movement. In this structure, the vehicle-body-side wire and the connectors are fixed to the slide member. The connector is accommodated by causing the slide member to perform sliding movement toward the top surface side of the headlining after the vehicle-body-side wire and the interior-part-side wire are connected by the connector during a state in which the slide member is drawn out of the attaching hole toward the bottom surface side of the headlining.

Thus, the slide member, to which the vehicle-body-side wire and the connector are fixed, is constructed in such a way as to be able to perform sliding movement with respect to the accommodating body fixed onto the top surface of the headlining. Therefore, the vehicle-body-side wire and the connector can be drawn to the bottom-surface-side of the headlining by causing a worker to pull the slide member out of the attaching hole. Further, the connector, in which the subconnectors are connected to each other, the vehicle-body-side wire, and the interior-part-side wire can be accommodated onto the top surface side of the headlining.

Moreover, because the connectors are fixed to the slide member, the connector can be fixed onto the top surface of the headlining through the slide member and the accommodating body.

Further, according to another aspect of the invention, the accommodating body has a section of a concave shape. Furthermore, guide groove portions are respectively formed in both concave side walls in such a way as to extend in a direction away from the attaching hole in a longitudinal direction. Further, each of the guide groove portions is the guide portion.

Thus, the slide member is enabled to perform sliding movement in a direction away from the attaching hole.

Moreover, according to another aspect of the invention, a latching portion adapted to be latched to the slide member is provided in the connector.

Thus, the connector can easily be fixed to the slide member.

Furthermore, according to another aspect of the invention, elongated hole portions provided in parallel to the guide groove portions are formed in both side walls of the guide body. In this structure, convex portions to be loosely fitted into the elongated hole portions are provided in the slide member.

Thus, each of the convex portions abuts against the edge of the corresponding elongated portion, so that the range, in which the slide member slides, is regulated.

Further, according to another aspect of the invention, the position-regulating means is a rear end part of each of the elongated hole portions.

Thus, the movement of the slide member can be regulated by using a simple structure.

Furthermore, according to another aspect of the invention, a positioning portion for latching a front end portion of the guide body to an end edge portion of the attaching hole is provided in the guide body.

Thus, an occurrence of displacement of the guide body can reliably be prevented when the guide body is fixed onto the top surface of the headlining.

DETAILED DESCRIPTION OF THE PREFERRED EMBODIMENTS

Hereinafter, preferred embodiments of the present invention will be described in detail with reference to the accompanying drawings. FIGS. 1 to 7B show a first embodiment of the invention. FIGS. 8 to 16 show a second embodiment of the invention.

Figure 1:
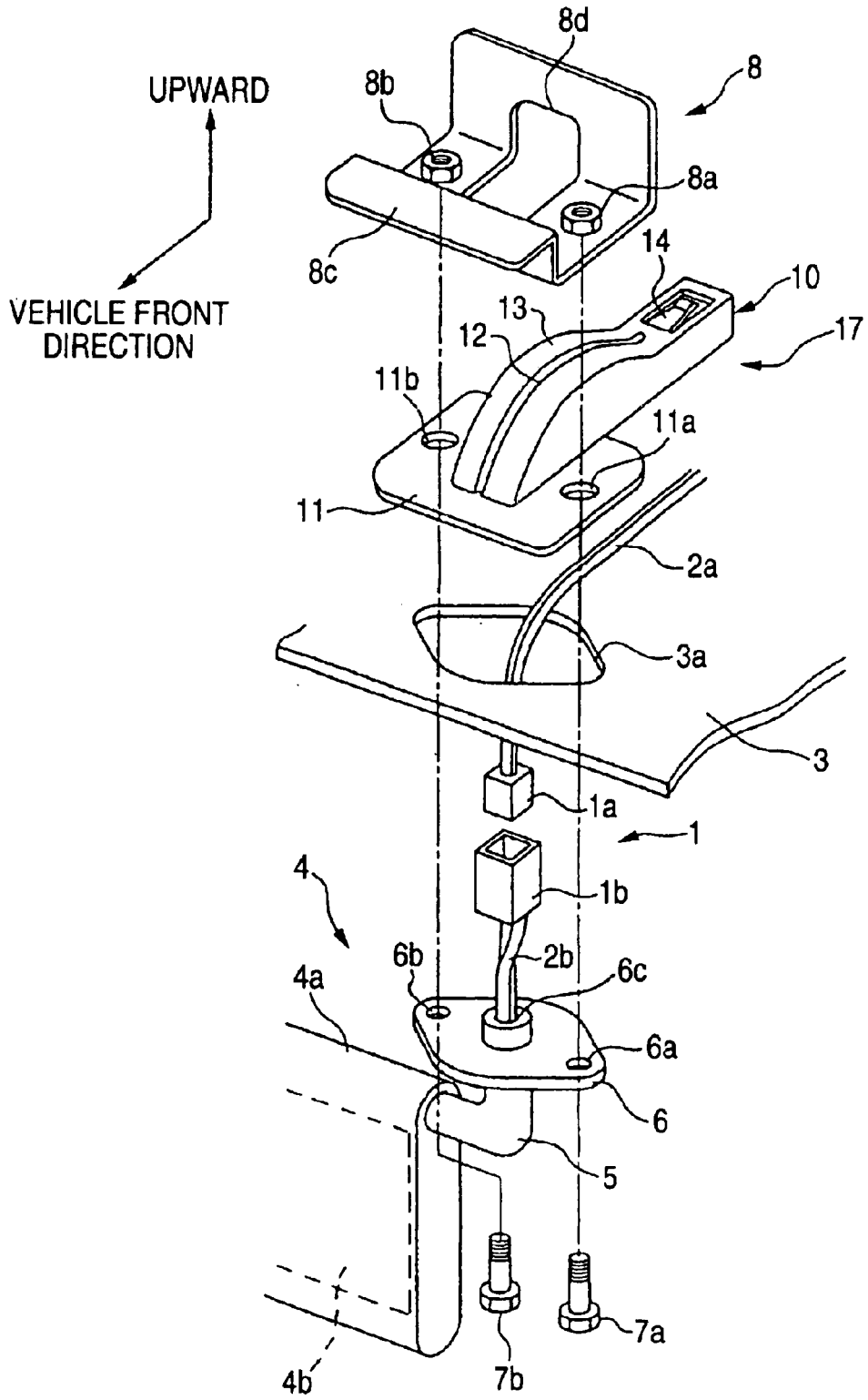
FIG. 1 is an exploded perspective view schematically showing a sun visor attaching structure to which a connector holding structure as a first embodiment of the invention is applied.
Figure 2A:
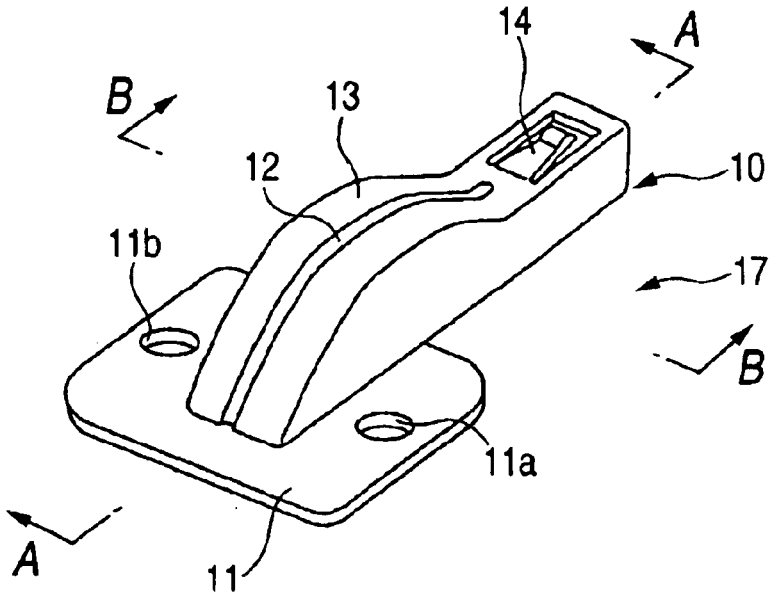
FIG. 2A is a top perspective view of the connector holding structure and FIG. 2B is a bottom perspective view of the connector holding structure.
Figure 2B:
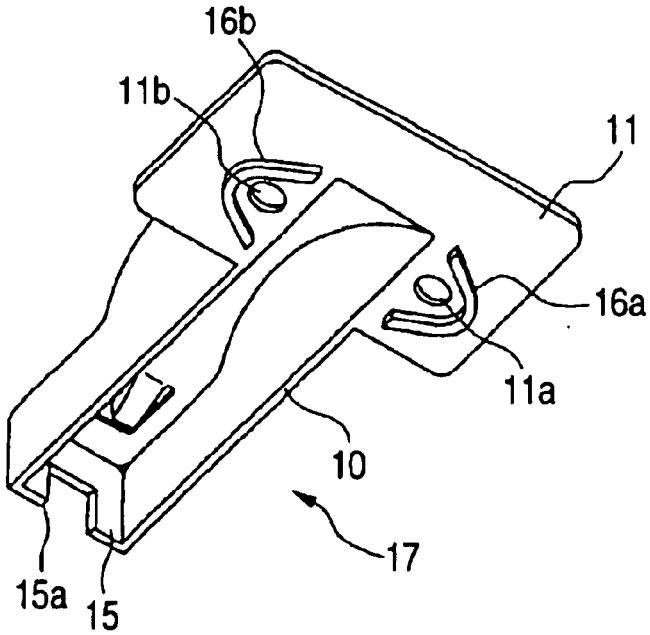
Figure 3A:
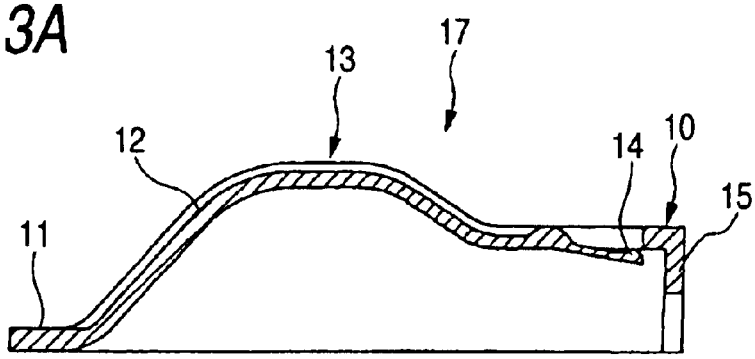
FIG. 3A is a sectional view taken along line A—A of FIG. 2A
Figure 3B:
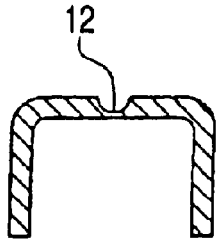
FIG. 3B is a sectional view taken along line B—B of FIG. 2A.
Figure 4:
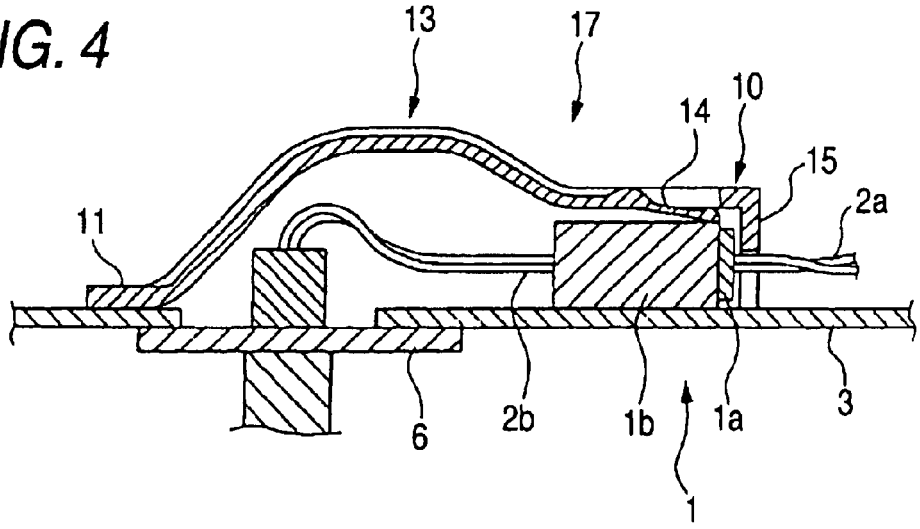
FIG. 4 is a sectional view of the connector holding structure showing a state in which a connector is fixed.

FIGS. 1 to 7B show a sun visor attaching structure, in which a connector holding structure of the first embodiment is applied to a sun visor serving as an interior part. FIG. 1 is a schematic exploded perspective view thereof. FIGS. 2A and 2B schematically show an accommodating mechanism thereof. FIGS. 3A and 3B show a sectional shape of the accommodating mechanism thereof. FIG. 3A is a sectional view taken along line A—A of FIG. 2A. FIG. 3B is a sectional view of taken along line B—B of FIG. 2A. FIG. 4 is a sectional view in a state in which a connector is pushed into the inside of the accommodating mechanism. In FIGS. 1 to 4, like reference characters designate like parts of the aforementioned conventional sun visor attaching structure.

In FIG. 1, reference numeral 4 denotes a sun visor, reference numeral 3 denotes a headlining, reference numeral 10 denotes a connector fixing cover (or cover body) serving as an accommodating body, reference numeral 8 denotes a body bracket, and reference numeral 17 denotes an accommodating mechanism.

The sun visor 4 comprises a sun visor body 4*a*, an arm 5, a base member 6, and harnesses 2*b* (that is, wires provided in the sun visor 4). Further, the sun visor body 4*a* is equipped with an electrical component 4*b*. In this embodiment, a face mirror (or vanity mirror) 4*b* having a lighting lamp is disposed in the sun visor body 4*a*.

The arm 5 is formed into a shape bent nearly at a right angle. The arm 5 ha a cavity formed inside thereof. One end of the arm 5 is connected to the sun visor body 4*a* in such a way as to enable the sun visor body 4*a* to turn around the arm 5 in vehicle front and rear directions. The other end of the arm 5 is rotatably attached to the bottom surface of the base member 6.

In the base member 6, holes 6*a* and 6*b* each for attaching the sun visor 4 to the headlining 3 are formed. Moreover, a hole portion 6*c* communicated to the cavity of the arm 5 is formed in a center portion of the base member 6.

The harnesses 2*b* are electric wires for supplying electric power to the lighting lamp of the vanity mirror that has the lighting lamp and that is equipped in the sun visor body 4*a*. One end portion of each of the harnesses 2*b* is connected to the lighting lamp. The other end portion of each of the harnesses 2*b* is made to upwardly extend from the base member 6 through the inside of the arm 5 and the central hole portion 6*c* of the base member 6. A subconnector 1*b* is attached to an end of each of the harnesses 2*b*.

The headlining 3 is attached to the ceiling portion of a vehicle interior. A hole (or attaching hole) for attaching the sun visor 4 thereto is formed therein.

Further, each of the harnesses 2*a* (that is, wires provided on the top surface side of the headlining 3) has an end connected to a battery (not shown) provided in an engine room and also has the other end, to which a subconnector 1*a* is attached. Each of the harnesses 2*a* is drawn from the engine room and attached onto the top surface of the headlining 3 through the inside of a pillar trim (not shown).

The body bracket 8 is formed in such a manner as to have a welding portion 8*c*, which is welded to a roof rail (not shown) provided on the ceiling portion of the vehicle interior, and also have nuts 8*a* and 8*b*, which are welded to places corresponding to the bolt holes 6*a* and 6*b* formed in the base member 6 of the sun visor 4, and a hole portion 8*d* formed in the central portion of the body bracket 8.

The cover body 10 is provided between the body bracket 8 and the headlining 3 and forms a space, which accommodates the connector 1 (the connector in which the subconnectors 1*a* and 1*b* are connected to each other) between the cover body 10 and the headlining 3, and is adapted to engage the hole portion 8*d* formed in the body bracket 8.

More particularly, as shown in FIGS. 2A, 2B, 3A, and 3B, a fixing portion 11, a guide face 13 serving as a guide portion, a claw portion 14 serving as a fixation portion, a longitudinal wall serving as a position-regulating portion, and a fragile groove portion serving as a fragile portion are formed in the cover body 10.

In the fixing portion 11, hole portions 11*a* and 11*b* are formed at places respectively corresponding to the bolt hole portions 6*a* and 6*b* formed in the base member 6 of the sun visor 4. Further, engaging portions 16*a* and 16*b* engaging the edge portion of the attaching hole 3*a* formed in the headlining 3 are formed on the bottom surface of the fixing portion 11.

Consequently, the cover body 10 can reliably be fixed at the predetermined place (that is, the part corresponding to the attaching hole 3*a* of ht e headlining 3) on the headlining 3 by an adhesive agent.

The guide face 13 is formed into a shape upwardly protruding from the cover body 10 by making a smooth curve from a front portion of an upper part of the cover body 10 to the rear portion thereof.

In case that the connector 1 is pushed thereinto when the sun visor 4 is attached to the headlining 3, the connector 1 is guided in such a way as to smoothly move to the predetermined position in the space formed between the cover body 10 and the headlining 3, that is, to the accommodating portion formed in the rear portion of the cover body 10.

The longitudinal wall 15 is formed in the rear portion of the cover body 10, and provided in such a manner as to regulate the connector 1 pushed into the space formed between the cover body 10 and the headlining 3.

Further, in the longitudinal wall 15, a cutout portion of a size permitting the harnesses 2*a* to pass therethrough 15*a* is formed.

Consequently, when the cover body 10 is fixed to the headlining 3, the cover body 10 is fixed to the headlining 3 without sandwiching the harnesses 2*a* between the cover body 10 and the headlining 3.

The claw portion 14 is formed in a rear part of the upper portion of the cover body 10 in such a way as to extend towards the inside of the cover body 10.

Consequently, the connector 1 is fixed by the claw portion 14 pressing the top surface of the connector 1 that is position-regulated by the longitudinal wall 15.

The fragile groove portion 12 is formed on the surface of the upper portion of the cover body 10 in such a way as to extend in a direction, in which the connector 1 is guided, from the front portion of the cover body 10 to the claw portion 14.

The sun visor attaching structure, to which the connector holding structure as the first embodiment of the invention is applied, is configured as described above. The procedure for attaching the sun visor is described below.

First, in a state in which the subconnector 1*a* attached to the harnesses 2*a* dangles downwardly from the attaching hole 3*a* of the headlining 3, an adhesive agent is applied onto the bottom surface of the fixing portion 11 of the cover body 10. Then, the cover body 10 is bonded onto the top surface of the headlining 3 while the engaging portions 16*a* and 16*b* of the fixing portion 11 are engaged with the edge portion of the attaching hole 3*a* of the headlining 3.

At that time, the harnesses 2*a* are adapted to pass through the inside of the cover body 10. Thus, the harnesses 2*a* are prevented from being sandwiched between the cover body 10 and the headlining 3. Further, the cover body 10 is fixed to the headlining 3 so that the harnesses 2*a* covered with the cover body 10 that is drawn out of the cutout portion 15*a* formed in the longitudinal wall 15 of the cover body 10 to the outside of the cover body 10.

Then, the headlining 3, to which the cover body 10 is fixed, is pushed up to the ceiling portion of the vehicle interior, so that the cover body 10 is engaged with the hole portion 8*d* of the body bracket 8.

Thereafter, the subconnector 1*b* of the sun visor 4 is connected to the subconnector 1*a* attached to the harnesses 2*a*. The connector 1, in which the subconnectors are connected to each other, is pushed above the headlining 3 through the attaching hole 3*a* of the headlining 3.

At that time, the connector 1 can be smoothly pushed to the predetermined position in the space formed between the cover body 10 and the headlining 3 along the guide face 13, which is formed on a front upper portion of the cover body 10.

The connector 1 is pushed into the inside of the cover body 10 still more, and then the connector 1 abuts against the longitudinal wall 15 formed on the rear portion of the cover body 10 and are position-regulated.

At that time, the harnesses 2*a* are pushed to the outside of the cover body 10 through the cutout portion 15*a* of the longitudinal wall 15. Thus, the harnesses 2*a* are prevented from being sandwiched between the longitudinal wall 15 and the connector 1.

The connector 1 position-regulated by the longitudinal wall 15 undergoes a downward pressure provided by the claw portion 14, which is formed in the rear upper portion of the cover body 10, and is fixed by being sandwiched between the claw portion 14 and the top surface of the headlining 3 (see FIG. 4).

Thereafter, the base member 6 of the sun visor 4 is caused to abut against the part corresponding to the attaching hole 3*a* of the headlining 3. The bolts 7*a* and 7*b* are screwed into the nuts 8*a* and 8*b* of the body bracket 8 through the bolt holes 11*a* and 11*b*, respectively. Thus, the sun visor 4 is attached to the headlining 3.

When the connector 1 is pushed onto the headlining 3 in the sun visor attaching structure, to which the connector holding structure of the invention is applied, the connector 1 can be smoothly pushed onto the headlining 3 by the guide face 13 formed on the cover body 10.

Further, the connector 1 can be position-regulated by the longitudinal wall 15 formed in the rear portion of the cover body 10.

Consequently, when the connector 1 is pushed thereonto until the connector 1 abuts against the longitudinal wall 15, the connector 1 is regulated to the predetermined position. Thus, the operation is easily performed. At that time, the harnesses 2*a* are allowed by the cutout portion 15*a* formed in the longitudinal wall 15 to pass therethrough and are pushed to the outside of the cover body 10. Thus, the harnesses 2*a* can be prevented from being sandwiched between the longitudinal wall 15 and the connector 1.

Further, because the upper part of the connector 1 position-regulated by the longitudinal wall 15 can be pressed by the claw portion 14 formed in the rear upper portion of the cover body 10, the connector 1 can be fixed at the predetermined position by being sandwiched between the claw portion 14 and the top surface of the headlining 3.

Consequently, abnormal noises (or clicks), which are generated by causing the connector 1 to vibrate and hit the headlining 3 during the vehicle traveling, can be eliminated.

Furthermore, because the cover body 10 covers the harnesses 2*a* and 2*b* and the connector 1 as described above, the movement of each of the harnesses 2*a* and 2*b* and the connector 1 can be restrained. Thus, the harnesses 2*a* and 2*b* and the connector 1 can be prevented from coming into contact with another vehicle part and being damaged. That is, for example, the harnesses 2*a* can be prevented from coming into contact with the body bracket 8 or the nuts 8*a* and 8*b* of the body bracket 8 and being damaged. Moreover, the harnesses 2*a* can be prevented from being sandwiched between the body bracket 8 and the headlining 3.

Furthermore, in a state in which the cover body 10 is fixed to the headlining 3, and in which the headlining 3 is pushed up to the ceiling portion of the vehicle interior, the sun visor 4 can be attached to the headlining 3 in a post-process (that is, the subconnectors 1*a* and 1*b* can be connected to each other and the connector 1 can be pushed onto the headlining 3). Thus, the operation can easily be performed, so that the workability can be enhanced.

Further, because the fragile groove portion 12 is formed in the upper portion of the cover body 10, the strength of the upper portion of the cover body 10 can partly be decreased. Even when an impact load is input by, for instance, a vehicle collision, the upper portion of the cover body 10 tears, so that the cover body 10 is crashed. Thus, an excessive impact force provided to another part at an instance of the collision can be alleviated.

Although the first embodiment of the invention has been described, the invention is not limited to the aforementioned embodiment. Various kinds of modifications of the invention can be made without departing from the spirit of the invention.

Figure 5A:
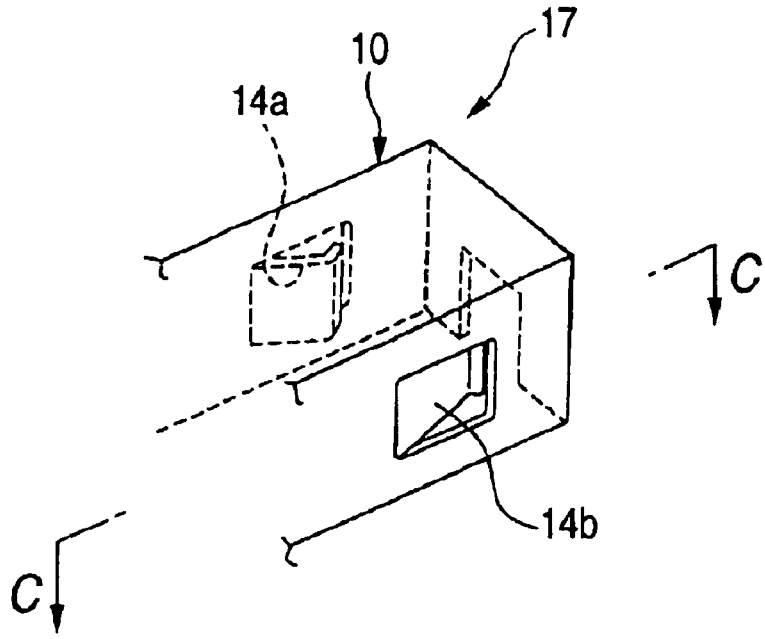
FIG. 5A is a top perspective view showing a connector holding structure, which is a modification of the first embodiment.
Figure 5B:
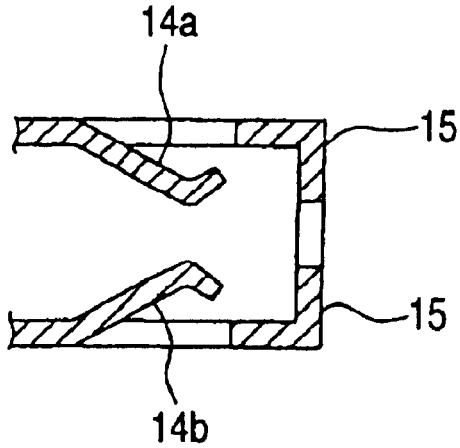
FIG. 5B is a sectional view taken along line C—C of FIG. 5A.

For example, as shown in FIGS. 5A and 5B, a claw portion of the cover body 10 may be formed on each of both sides of the rear portion of the cover body 10 in such a way as to extend toward the inside thereof (that is, claw portions 14*a* and 14*b* may be provided therein). The connector 1 may be fixed by pressing the connector 1 from both side portions of the connector 1.

Figure 6:
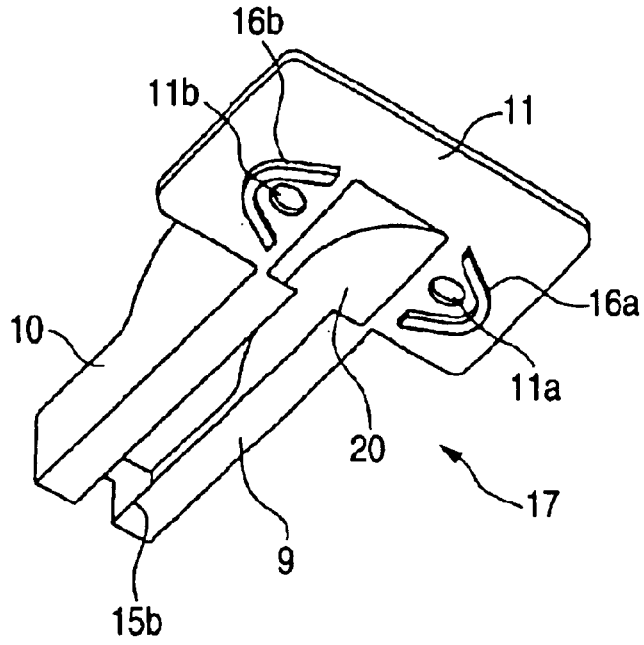
FIG. 6 is a schematic bottom perspective view showing a connector holding structure which is a modification of the first embodiment.

Further, as shown in FIG. 6, a bottom surface portion 9 for closing a bottom aperture in the cover body 10 may be provided in the bottom surface of the cover body 10. In this case, an opening portion 20 for inserting the connector 1 into the cover body 10, and a cutout portion 15*b* for inserting the harnesses 2*a* into the cover body 10 are secured.

Figure 7A:
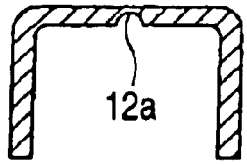
FIGS. 7A and 7B are sectional views each schematically showing a groove portion of a connector holding structure which is a modifications of the first embodiment.

Further, although the fragile groove portion 12 serving as the fragile portion is formed on the upper surface of the upper portion of the cover body 10 from the front portion of the cover body 10 to the claw portion 14 in the aforementioned embodiment, a fragile groove portion 12*a* may be formed on the under surface of the upper portion of the cover body 10 from the front portion of the cover body 10 to the claw portion 14, as shown in FIG. 7A. Moreover, both the fragile groove portions 12 and 12*a* may be formed in the cover body 10.

Figure 7B:
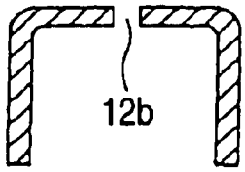

Moreover, as shown in FIG. 7B, a slit 12*b* may be formed in the upper portion of the cover body 10 from the front portion of the cover body 10 to the claw portion 14.

Furthermore, a concave portion (or depression) engaging an end part of the claw portion 14 may formed in the upper portion of the connector 1. Consequently, the connector 1 can be position-regulated by engaging this concave portion and the end part of the claw portion 14. Moreover, a downward pressure due to the claw portion 14 is applied onto the top surface of the connector 1, so that the connector 1 can be fixed. That is, both the position-regulating portion and the fixation portion may be formed together.

Figure 8:
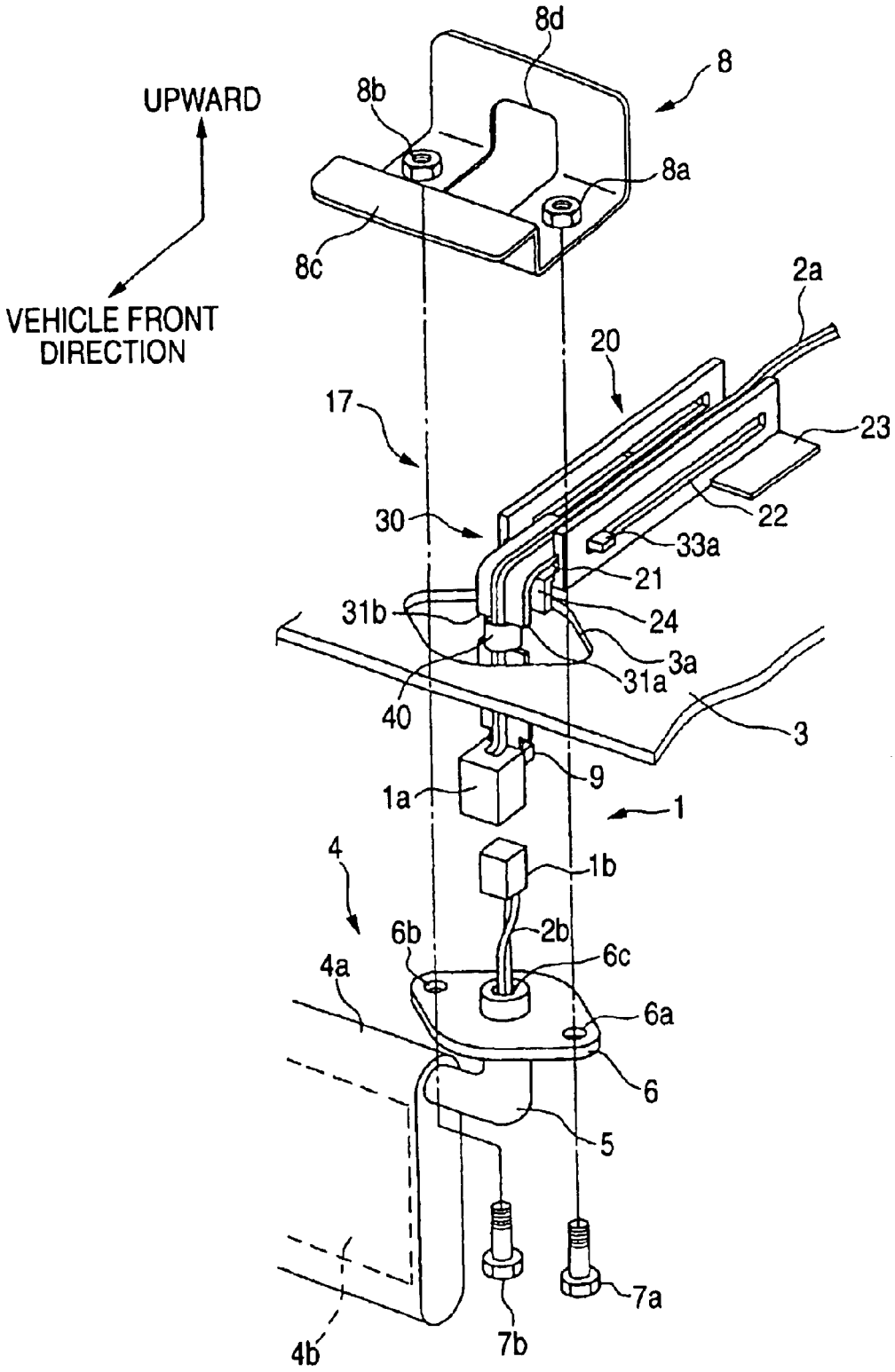
FIG. 8 is an exploded perspective view schematically showing a sun visor attaching structure to which a connector holding structure as a second embodiment of the invention is applied.
Figure 9:
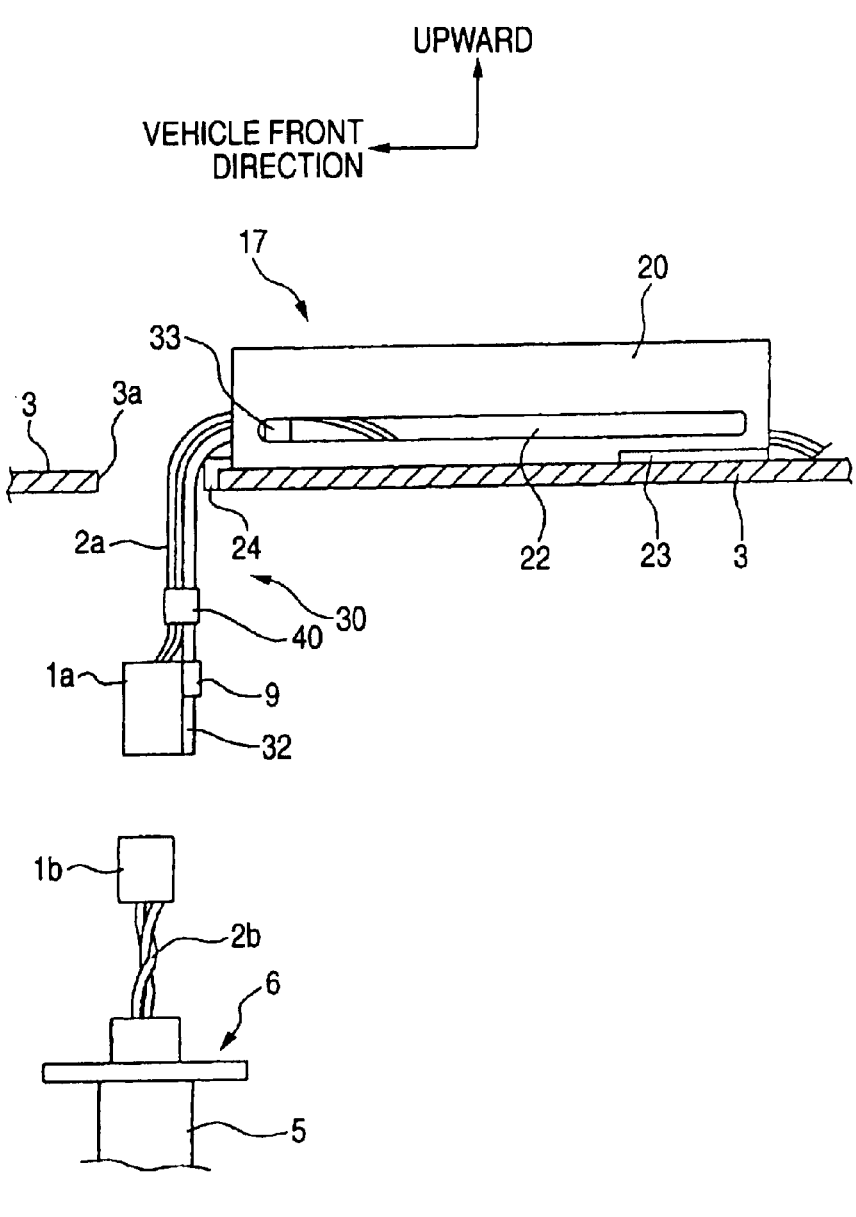
FIG. 9 is a side view showing the sun visor attaching structure.
Figure 10:
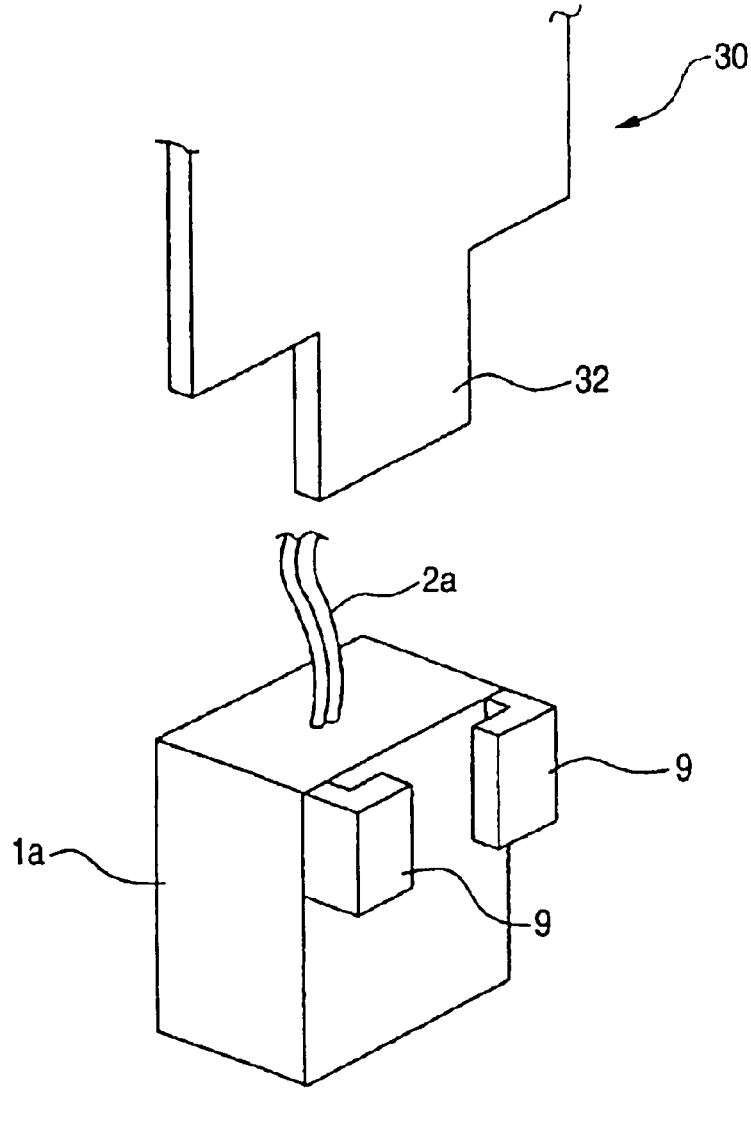
FIG. 10 is a perspective view showing a latching relation between a connector and a sliding member of the second embodiment.
Figure 11:
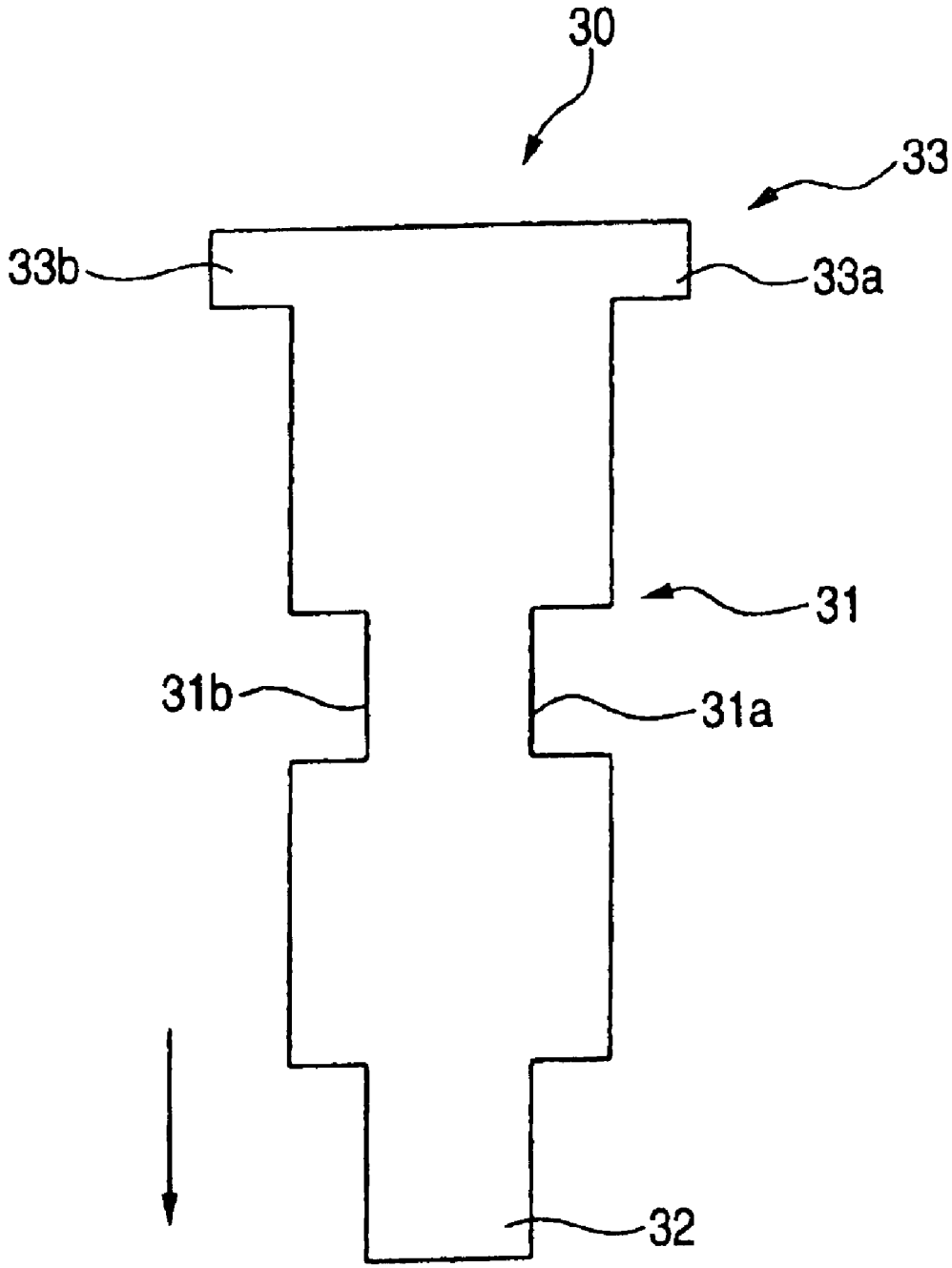
FIG. 11 is a plan view showing the sliding member of the second embodiment.
Figure 12:
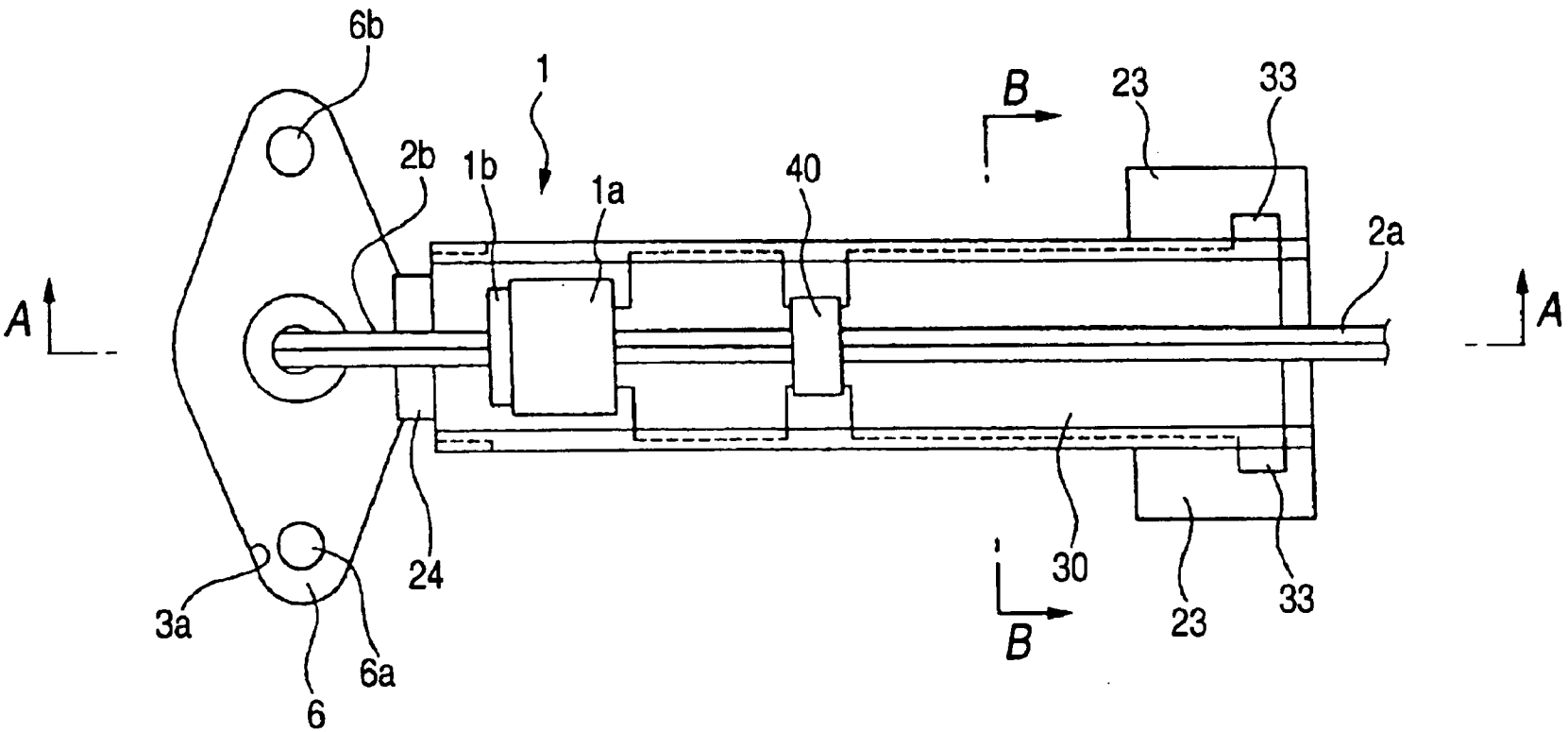
FIG. 12 is a plan view showing a state in which the sliding member of the second embodiment is accommodated on a headlining.
Figure 13:
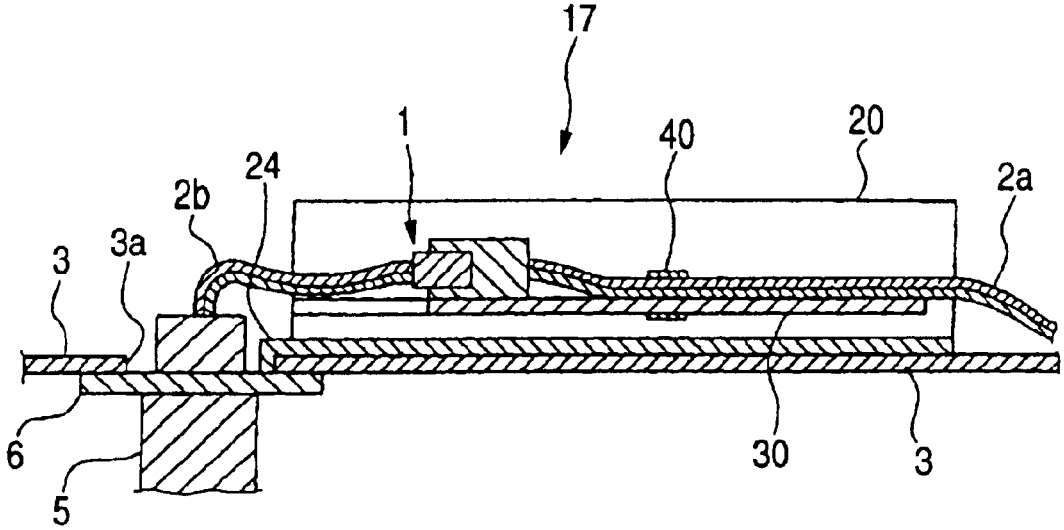
FIG. 13 is a sectional view of the second embodiment taken along line A—A of FIG. 12.
Figure 14:
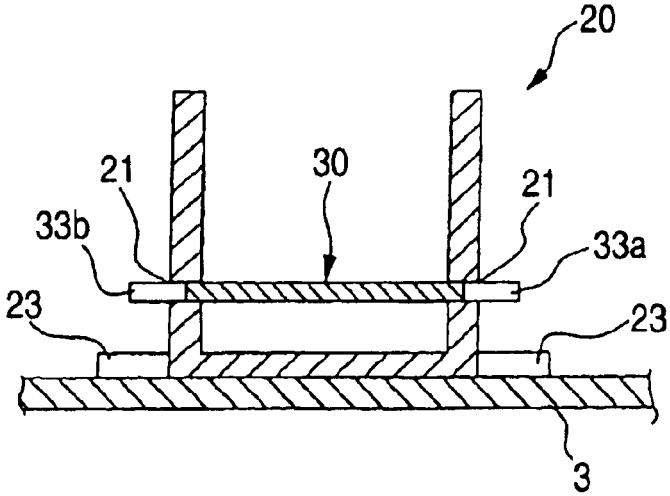
FIG. 14 is a sectional view of the second embodiment taken along line B—B of FIG. 12.

Next, a second embodiment of the invention is described below by referring to FIGS. 8 to 16. The second embodiment differs from the first embodiment in the structure of the accommodating body. FIG. 8 is a schematic exploded perspective view of the second embodiment. FIG. 9 is a side view thereof. FIG. 10 is a view illustrating the engaging relation between a slide member and a connector. FIG. 11 is a plan view showing the slide member. FIG. 12 is a plan view in a case that the connector is accommodated onto a headlining. FIG. 13 is a sectional view taken along line A—A of FIG. 12. FIG. 14 is a sectional view taken along line B—B of FIG. 12. In FIGS. 8 to 14, like reference characters designate like parts that have been described in the foregoing description of the first embodiment. Thus, the description of such parts is omitted herein.

An accommodating mechanism 17 comprises a guide body 20, which serves as an accommodating body, and a slide member 30.

The guide body 20 is made of a flexible material, such as a plastic material, and shaped in such a way as to have a concave section. Further, guide groove portions 21 each serving as a guide portion, an elongated hole portion 22, a fixing portion 23, and a positioning portion 24 (see FIG. 9) are formed in the guide body 20.

The guide groove portions 21 are formed in the inside of each of both the side portions of the guide body 20 in the longitudinal direction in such a way as to extend in a direction departing away from the attaching hole 3*a*, and in such a way as to be nearly parallel to the bottom surface of the guide body 20 at a predetermined height from the bottom surface thereof. Consequently, the sliding movement of a slide member 30 (to be described later) in a direction departing away from the attaching hole 3*a* is enabled. Further, the lateral movement and the upward and downward movements of the slide member 30 are regulated.

The slide member 30 adapted to perform sliding movement in each of the guide groove portions 21 can be pushed for drawing out or accommodating. The pushing operation is performed by a worker. Thus, when the worker does not perform such an operation, the slide member 30 is held at a position in a sliding-movement direction by the sliding resistance caused between the slide member 30 and each of the guide groove portions 21.

The elongated hole portion 22 is formed in each of both side portions of the guide body 20 in such a way as to extend in parallel to the guide groove portions 21, and formed at a predetermined height from the bottom surface of the guide body 20 in such a manner as to extend in parallel to the bottom surface of the guide body 20.

In this embodiment, the guide groove portions 21 and the elongated hole portion 22 are formed at the same height from the bottom surface of the guide body 20.

The fixing portion 23 is formed in the rear portion side of the bottom surface of the guide body 20 in such a way as to extend to the outward direction of the width of the guide body 20.

The bottom surface of the fixing portion 23 of the guide body 20 is bonded to the top surface of the headlining 3 by an adhesive agent, so that the guide body 20 is fixed onto the headlining 3.

As shown in FIG. 9, a positioning portion 24 is formed at the front of the guide body 20 in such a way as to engage the edge portion of the attaching hole 3*a* of the headlining 3.

As shown in FIG. 10, a latching portion 9 adapted to be latched to the front end portion of the slide member 30 of the guide member 10 (to be described later) is formed in the subconnector 1*a*. By this structure, the subconnector 1*a* is fixed to the front end portion of the slide member 30.

As shown in FIG. 11, the slide member 30 has a nearly rectangular shape, and is formed like a plate and made from a flexible material such as a plastic material. Further, a cutout portion 31, a projecting piece 32, and a convex portion 33 are formed in the slide member 30.

The cutout portion 31 includes cutout parts 31*a* and 31*b* respectively formed on both side portions of the slide member 30. As shown in FIG. 8, a fixation member 40, such as adhesive tape, is wound around the slide member 30 in the direction of width thereof along the bottom side of each of the cutout portions 31*a* and 31*b*.

The projecting piece 32 is formed at the front of the slide member 30 and adapted to be latched to the latching portion 19 of the subconnector 1*a*.

The convex portion 33 includes protruding pieces 33*a* and 33*b* respectively formed on rear part of each long side of the slide member 30 in such a way as to extend outwardly in a direction of width of the slide member 30. Further, the convex portion 33 (that is, the protruding pieces 33*a* and 33*b*) is adapted to be loosely fitted into the elongated hole portion 22 of the guide body 20.

Consequently, when the slide member 30 is drawn out of the attaching hole 3*a* to the bottom surface side of the headlining 3, the protruding pieces of the convex portion 33 abut against the front side edge portion of the elongated hole portion 22 of the guide body 20, respectively. Thus, the slide member 30 is latched thereto. Moreover, the movement of the slide member 30 is regulated.

Further, when the slide member 30 is accommodated in the guide body 20 from a state in which the slide member 30 hangs frontwardly and downwardly from the guide body 20, the protruding pieces of the convex portion 33 abut against the rear side edge part of the elongated portion 22 of the guide member 20, respectively, so that the slide member 30 is latched thereto. Thus, the movement of the slide member 30 is regulated.

The sun visor attaching structure, to which the connector holding structure as the second embodiment of the invention is applied, is configured as described above. The procedure for attaching the sun visor 4 to the headlining 3 is described below.

An adhesive agent is applied to the bottom surface of the fixing portion 23 of the guide body 20. The guide body 20 is fixed to the top surface of the headlining 3 in a state in which the positioning portion 24 of the guide body 20 is engaged with the edge portion of the attaching hole 3*a* of the headlining 3.

Furthermore, the harnesses 2*a* pass through the top surface of the slide member 30 and between each of both side portions of the guide body 20. Then, the projecting piece 32 provided at the front end of the slide member 30 is latched to the latching portion 9 of the subconnector 1*a*, so that the subconnector 1*a* is fixed to the slide member 30.

Thereafter, in the cutout portion 31 of the slide member 30, the harnesses 2*a* are fixed to the slide member 30 by the fixation member 40. Consequently, when the slide member 30 is drawn out of the attaching hole 3*a* to the bottom surface side of the headlining 3, the subconnector 1*a* is drawn to the bottom surface side of the headlining 3. This facilitates the operation of drawing out the subconnector 1*a*.

Then, the headlining 3 is pushed up so that the guide body 20 is inserted into the hole portion 8*d* of the body bracket 8. Thus, the headlining 3 is attached to the ceiling portion of the vehicle interior.

Thereafter, as illustrated in FIGS. 12 and 13, the subconnectors 1*a* and 1*b* are connected to each other. When the connector 1, in which the subconnectors 1*a* and 1*b* are connected to each other (that is, the connected subconnectors 1*a* and 1*b*), are pushed from the attaching hole 3*a* onto the top surface side of the headlining 3, the slide member 30 performs sliding movement along the guide groove portions 21 of the guide body 20. Thus, the connector 1 can easily be guided onto the headlining 3 and accommodated (or put) thereon. In FIGS. 12 and 13, the drawing of the body bracket is omitted. FIG. 14 illustrates the engaging relation between the slide member 30 and the guide body 20.

Further, the harnesses 2*a* and 2*b* are guided in a direction departing away from the attaching hole 3*a* and accommodated by the sliding movement of the slide member 30.

Then, the base member 6 of the sun visor 4 is caused to abut against a part corresponding to the attaching hole 3*a* of the headlining 3. The bolts 7*a* and 7*b* are screwed into the nuts 8*a* and 8*b* of the body bracket 8 through the bolt holes 6*a* and 6*b* of the base member 6, respectively. Thus, the sun visor 4 is attached to the headlining 3.

As described above, the accommodating mechanism 17 of the second embodiment of the invention is configured so that the slide member 30, to which the harnesses 2*a* are fixed, can perform sliding movement with respect to the guide body 20 fixed onto the top surface of the headlining 3. Therefore, the harnesses 2*a* can be drawn out to the bottom surface side of the headlining 3 by drawing out the slide member 30 through the attaching hole 3*a* to the bottom surface side of the headlining 3. The operation of drawing out the harnesses 2*a* to the bottom surface side of the headlining 3, which is performed before the harnesses 2*a* are connected to the harnesses 2*b*, can easily be performed.

Further, the connected harnesses 2*a* and 2*b* can be accommodated onto the top surface side of the headlining 3 by causing the worker to perform sliding movement of the slide member 30 to the top surface side of the headlining 3. Thus, the operation of accommodating the connected harnesses 2*a* and 2*b* can easily be performed.

Furthermore, the accommodating mechanism 17 of the second embodiment is configured so that the slide member 30 performs sliding movement in a direction departing away from the attaching hole 3*a*. Thus, the connected harnesses 2*a* and 2*b* can be accommodated by being moved in a direction departing away from the attaching hole 3*a*. Consequently, the accommodated harnesses 2*a* and 2*b* can be prevented from abutting the members (that is, the body bracket 8, the bolts 7*a* and 7*b*, and the nuts 8*a* and 8*b*) used for attaching the sun visor 4 and being damaged.

Further, in the accommodating mechanism 17 of the second embodiment, the groove portions 21 extending in a direction departing away from the attaching hole 3*a* are formed in the guide body 20. Thus, the sliding movement in a direction away from the attaching hole 3*a* of the slide member 30 is enabled. Moreover, movements in directions other than the direction, in which the sliding movement is performed, are regulated.

Further, the accommodating mechanism 17 of the second embodiment is configured so that the subconnector 1*a* is latched to the slide member 30. Moreover, the accommodating mechanism 17 is configured so that the slide member 30 is held at the position with respect to the guide body 20 by the sliding resistance. Therefore, the subconnector 1*a* can be fixed to the headlining 3 through the slide member 30*a* and the guide body 20. Thus, it can be prevented that the subconnector 1*a* abuts against the top surface of the headlining 3 and that abnormal noises are generated.

Furthermore, the accommodating mechanism 17 of the second embodiment is configured so that the convex portions 30 abut against the edge parts of the elongated hole portions 22, and that the range, in which the slide member 30 slides, is regulated. Therefore, the slide member 30 can reliably be prevented from dropping off the guide body 20. Consequently, the operation of drawing out the harnesses 2*a* to the bottom surface side of the headlining 3, and the operation of accommodating the connected harnesses 2*a* and 2*b* can easily be performed.

Further, the accommodating mechanism 17 of the second embodiment is configured so that the positioning portion 24 is latched to the edge portion of the attaching hole 3*a*. Therefore, the displacement of the guide body 20 can reliably be prevented by a simple structure from occurring when the worker causes the guide body 20 to be fixed to the top surface of the headlining 3. Thus, the slide member 30 can reliably be drawn out by a sufficient length from the attaching hole 3*a* of the slide member 30 to the bottom surface side of the headlining 3. Consequently, the operation of connecting the harnesses 2*a* and 2*b* to each other, and the operation of accommodating the connected harnesses 2*a* and 2*b* can easily be performed.

Figure 15:
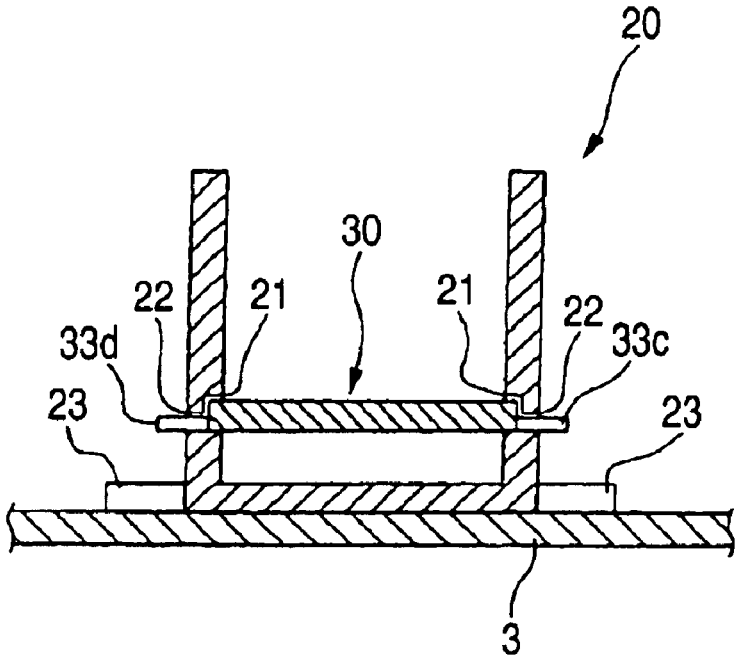
FIG. 15 is a sectional view showing a modification of the second embodiment.

Although the second embodiment of the invention has been described above, a modification thereof may be made by, for instance, forming concave portions 33*c* and 33*d*, whose thicknesses are small, and elongated hole portions respectively engaging the concave portions 33*c* and 33*d*, as shown in FIG. 15.

Figure 16:
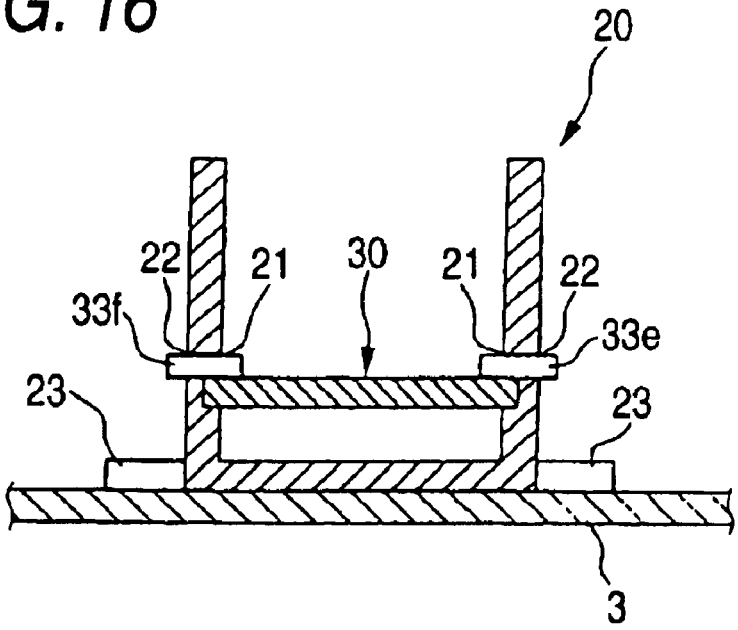
FIG. 16 is a sectional view showing a modification of the second embodiment.
Figure 17:
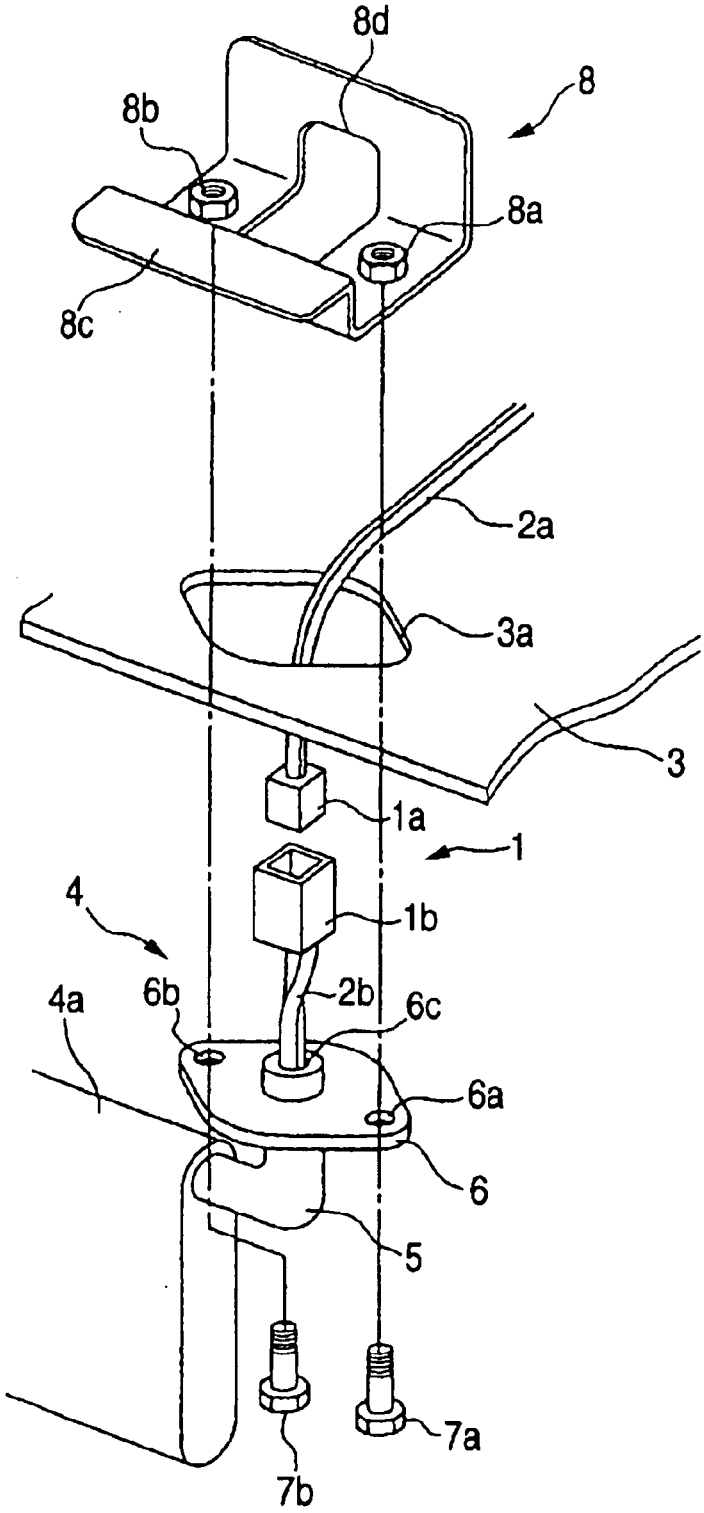
FIG. 17 is a perspective view schematically showing a conventional sun visor attaching structure.
Figure 18:
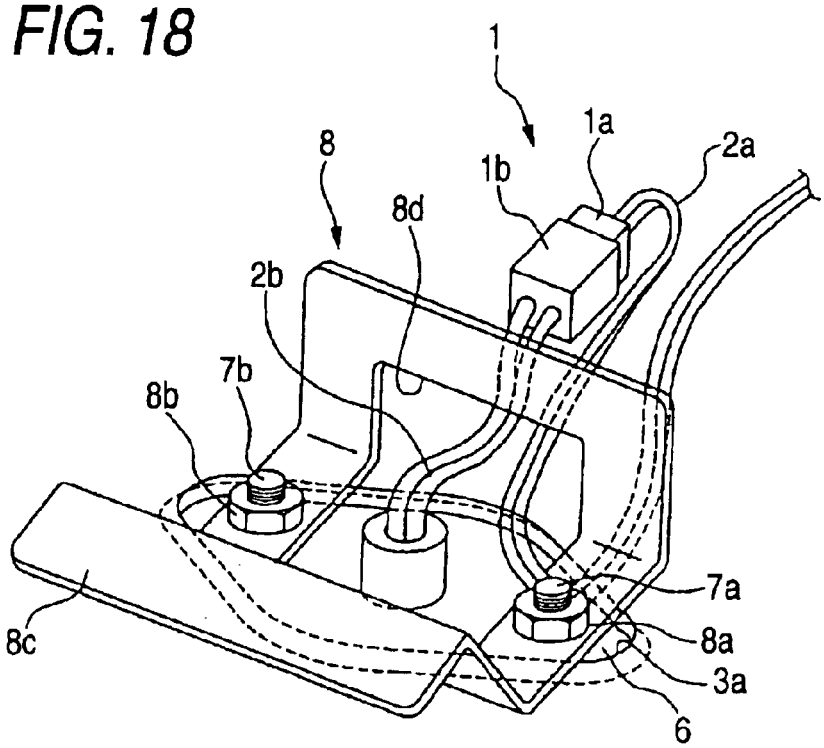
FIG. 18 is a perspective view schematically showing the conventional sun visor attaching structure.
Figure 19:
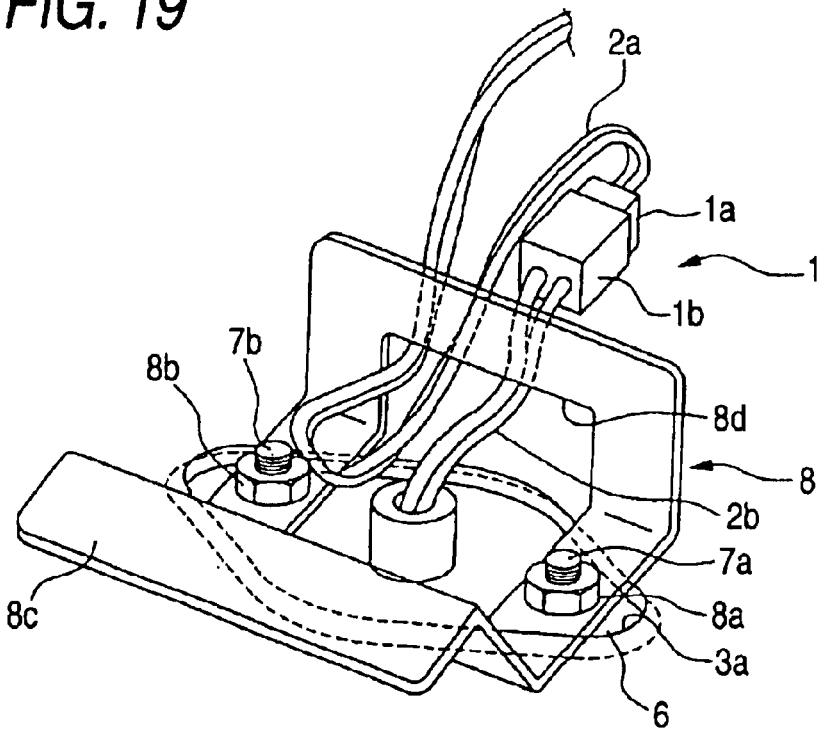
FIG. 19 is a perspective view schematically showing the conventional sun visor attaching structure.

Further, as shown in FIG. 16, convex portions 33*e* and 33*f* may be formed on the top surface of the slide member 30, and moreover, elongated hole portions adapted to engage the convex portions 33*e* and 33*f* may be formed.

By such structures, the lateral movement of the slide member 30 can reliably be regulated.

Further, although the case, in which the sun visor 4 having the harnesses 2*b* is attached to the headlining 3, has been described in the descriptions of the first and second embodiments, the invention can be applied to the case that another interior part (for example, a room lamp) having a wire (or harness) is attached to the headlining.

What is claimed is:

1. A connector holding structure comprising:

a connector for connecting a vehicle-body-side wire provided on a top surface side of a vehicle headlining to an interior-part-side wire provided on an interior part attached to an attaching hole formed in the headlining, the connector including subconnectors that are connectable to each other; and an accommodating means for guiding the connector, with the subconnectors connected to each other, into the attaching hole from a bottom surface side of the headlining to the top surface side of the headlining, and for holding the connector, wherein the accommodating means comprises:

an accommodating body fixed onto a top surface of the headlining and extending in a direction departing away from the attaching hole;

a guide portion for guiding and directing the connector, with the subconnectors connected to each, to a predetermined position in the accommodating body, away from the attaching hole; and a holding member for holding the connector at the predetermined position.

2. The connector holding structure according to claim 1, wherein the accommodating body is a cover body fixed onto the top surface of the headlining to thereby form a space, in which the connector is accommodated, between the cover body and the headlining,and wherein the guide portion is an upper wall portion of the cover body formed into a shape protruding upwardly from the cover body by making a smooth curve from a front portion of the cover body to a rear portion thereof.

3. The connector holding structure according to claim 2, wherein the holding member comprises:

a position-regulating member for position-regulating the connector to a predetermined position; and a fixing portion for fixing the position-regulated connector.

4. The connector holding structure according to claim 3, wherein the position-regulating member is a longitudinal wail formed at a rear end portion of the cover body and adapted to abut against the connector.

5. The connector holding structure according to claim 3, wherein the fixing portion is a claw portion formed on a peripheral wall of the rear portion of the cover body in such a manner as to extend to inside of the cover body.

6. The connector holding structure according to claim 2, wherein a fragile groove or a fragile slit portion is formed in an upper wall portion of the cover body from the front portion thereof to the rear portion thereof.

7. The connector holding structure according to claim 1, wherein the accommodating means further comprises a flexible slide member adapted to engage the accommodating body in such a way as to be able to perform sliding movement, wherein the vehicle-body-side wire and the connector are fixed to the slide member, and wherein the connector is accommodated by causing the slide member to perform sliding movement toward the top surface side of the headlining after the vehicle-body-side wire and the interior-part-side wire are connected by the connector during a state in which the slide member is drawn out of the attaching hole toward the bottom surface side of the headlining.

8. The connector holding structure according to claim 7, wherein the accommodating body has a section of a concave shape, wherein guide groove portions are respectively formed in both concave side walls in such a way as to extend in a rear direction departing away from the attaching hole, and wherein each of the guide groove portions is the guide portion.

9. The connector holding structure according to claim 7, wherein a latching portion adapted to be latched to the slide member is provided in the connector.

10. The connector holding structure according to claim 8, wherein elongated hole portions provided in parallel to the guide groove portions are formed in both side walls of the guide body, and wherein convex portions to be loosely fitted into the elongated hole portions are provided in the slide member.

11. The connector holding structure according to claim 10, wherein the position-regulating member is a rear end part of each of the elongated hole portions.

12. The connector holding structure according to claim 7, wherein a positioning portion for latching a front end portion of the guide body to end edge portion of the attaching hole is provided in the guide body.

13. A connector holding structure comprising:

a connector for connecting a vehicle-body-side wire provided on a top surface side of a vehicle headlining to an interior-part-side wire provided on an interior part attached to an attaching hole formed in the headlining; and an accommodating means for guiding the connector into the attaching hole from a bottom surface side of the headlining to the top surface side of the headlining, and for holding the connector, wherein the accommodating means comprises:

an accommodating body fixed onto a top surface of the headlining and extending in a direction departing away from the attaching hole;

a guide portion for guiding the connector to a predetermined position in the accommodating body, away from the attaching hole, the guide portion having an upper wall portion protruding upwardly from the accommodating body and being curved from a front portion thereof that is above the attaching hole to a rear portion thereof; and a holding member for holding the connector at the predetermined position, the holding member having a fixing portion for fixing the connector, wherein the upper wall portion extends toward the fixing portion.

* * * * *